US009706823B2

(12) United States Patent
Efron

(10) Patent No.: US 9,706,823 B2
(45) Date of Patent: Jul. 18, 2017

(54) SPACE SAVING LUGGAGE AND VACUUM ASSEMBLY

(71) Applicant: Chad Efron, Port St. Lucie, FL (US)

(72) Inventor: Chad Efron, Port St. Lucie, FL (US)

(73) Assignee: THE ULTIMATE CARRY ON, LLC, Port Saint Lucie, FL (US)

( * ) Notice: Subject to any disclaimer, the term of this patent is extended or adjusted under 35 U.S.C. 154(b) by 32 days.

(21) Appl. No.: 14/612,512

(22) Filed: Feb. 3, 2015

(65) Prior Publication Data

US 2016/0219996 A1 Aug. 4, 2016

(51) Int. Cl.
*A45C 5/03* (2006.01)
*B65B 31/04* (2006.01)
*A45C 13/02* (2006.01)

(52) U.S. Cl.
CPC ..... *A45C 5/03* (2013.01); *B65B 31/04* (2013.01); *A45C 2013/028* (2013.01)

(58) Field of Classification Search
CPC ..... A45C 5/03; A45C 2013/028; B65B 31/04
USPC ..... 206/524.8; 150/1, 103; 190/103, 36, 190/107, 110
See application file for complete search history.

(56) References Cited

U.S. PATENT DOCUMENTS 4,044,867 A * 8/1977 Fisher ..... A45C 7/004 190/107
5,806,575 A * 9/1998 Tsay ..... B65D 81/2015 141/192
6,135,253 A * 10/2000 Weissman ..... A45C 13/02 190/110
6,499,574 B1 12/2002 Anthony
7,422,476 B2 * 9/2008 Marmaropoulos .... A45C 15/00 185/15
8,042,662 B2 * 10/2011 Su ..... A45C 5/04 16/113.1
8,251,192 B1 8/2012 Milani
8,319,630 B1 * 11/2012 Salwan ..... A45C 5/00 206/459.5
8,459,422 B1 * 6/2013 Efron ..... A45C 13/02 190/109
2006/0151354 A1 * 7/2006 Dombroski ..... B65D 81/2053 206/524.8
2006/0207849 A1 * 9/2006 Sadow ..... A45C 7/0081 190/18 A (Continued)

FOREIGN PATENT DOCUMENTS

JP 200340531 A * 2/2003

*Primary Examiner* — Sue A Weaver
(74) *Attorney, Agent, or Firm* — The Concept Law Group, P.A.; Scott D. Smiley; Paul Murty

(57) ABSTRACT

A space saving luggage assembly with a luggage body having a plurality of side walls and an inner back support surface defining an article placement zone and a cover thereto that includes an open position exposing the article placement zone to an ambient environment and a closed position encapsulating the article placement zone. The space saving luggage assembly also includes a battery-powered vacuum assembly integrated into one of a plurality of side walls of the luggage body and having a tube, defining a tube conduit, with a free end disposed within the article placement zone when the cover is in the closed position, the battery-powered vacuum assembly operably configured to induce a vacuum within the tube conduit.

15 Claims, 9 Drawing Sheets

(56) References Cited

U.S. PATENT DOCUMENTS

| | | | | |
|---|---|---|---|---|
| 2011/0259693 | A1* | 10/2011 | Nascarella | A45C 7/0022<br>190/18 A |
| 2011/0293205 | A1* | 12/2011 | Piazza | B65D 81/2023<br>383/103 |
| 2013/0048456 | A1* | 2/2013 | Govor | A45C 13/02<br>190/111 |
| 2013/0180816 | A1* | 7/2013 | Wytenhove | A45C 5/03<br>190/103 |
| 2013/0271063 | A1* | 10/2013 | Wilson | A45C 5/14<br>320/103 |

* cited by examiner

100

100

SPACE SAVING LUGGAGE AND VACUUM ASSEMBLY

FIELD OF THE INVENTION

The present invention relates generally to luggage assemblies, and more particularly relates to a luggage assembly operably configured to remove air from a compression bag insertable therein.

BACKGROUND OF THE INVENTION

Many people travel or commute from one point to another. When they do, most people use luggage to transport their clothing and other personal items. For most consumers, the size of the luggage and spatial efficiency of the compartments therein is very important because if the user is required to take a significant amount of items he or she may need to take more than one piece of luggage. This is not only extremely inconvenient, but it also may result in additional bag fees by transportation carriers.

Some users attempt to solve this problem by utilizing compression, or vacuum bags in conjunction with the luggage. In this vein, many users place their articles in a compression bag, remove the air within using a vacuum at the user's residence or place of abode, and pack those vacuum bags in his or her luggage. This comes with an obvious disadvantage of having to find a vacuum at his or her destination and, if no vacuum is found, attempt to pack an excessive amount of items in the luggage, discard those items that don't fit, buy a vacuum that is then required to be packed or thrown away, or buy another piece of luggage.

Some known assemblies attempt to solve the aforementioned problem by using an integrated vacuum bag that has its air removed to seal the contents within via vacuum assembly installed on the luggage. As the vacuum bag is integrated, it extremely limits the user's versatility in choosing different sizes of bags for different items. Additionally, many users desire to only have some items compressed due to the type of item being packed. Further, many of these luggage assemblies require alignment of a piece of the vacuum assembly with a portion of the vacuum bag in order for the system, i.e., vacuum, to function properly. As such, the alignment of the vacuum bag with the piece of the luggage can be become an arduous and time-intensive task.

Many vacuum assemblies that utilize a vacuum also have structure associated with that vacuum assembly that is exposed on the outer surface, or otherwise increases the surface area of width of the luggage. As such, the vacuum assembly is prone to striking other structures during use, thereby increasing the probability of damaging the vacuum assembly or the structural integrity of the luggage itself, both of which are extremely problematic. Having a piece of luggage that is readily identifiable as having a vacuum assembly is also disadvantageous because of the increase probability of theft.

Another disadvantage with many known luggage assemblies is that they do not provide the user the ability to charge their phones or other electronic devices. This is extremely important to many users who travel and do not have access to electrical outlets. If any luggage assemblies do provide the user with the ability to charge his or her phone, that charging unit is a stand-alone system that does not utilize a pre-existing power supply operating a vacuum assembly, thereby generating a device that is cost, space, and energy efficient.

Therefore, a need exists to overcome the problems with the prior art as discussed above.

SUMMARY OF THE INVENTION

With the foregoing and other objects in view, there is provided, in accordance with the invention, a space saving luggage assembly that has a luggage body with a base that includes a handle coupled thereto. The base has an inner back support surface and a plurality of side walls extending in a direction away from the back surface and that surround the inner back support surface. The plurality of side walls and the inner back support surface define an article placement zone for which articles are placed. The luggage assembly also has a cover coupled to the base that has an open position exposing the article placement zone to an ambient environment and a closed position encapsulating the article placement zone. The luggage assembly has a battery-powered vacuum assembly integrated into one of the plurality of side walls and having a tube, which defines a tube conduit, with a free end disposed within the article placement zone when the cover is in the closed position. The battery-powered vacuum assembly is operably configured to induce a vacuum within the tube conduit so as remove gas, e.g., air, from a removable vacuum bag inserted therein.

In accordance with a further feature of the present invention, the space saving luggage assembly comprises a bracket mechanical coupled to at least one of the plurality of side walls, with the bracket defining a receiving surface adapted to removably retain a portion of the tube.

In accordance with another feature of the present invention, the space saving luggage assembly tube is removably fixedly retained to at least one of the plurality of side walls when the cover is in the closed position.

In accordance with an additional feature of the present invention, the space saving luggage assembly further comprises a storing position with the tube in an overlapping and substantially parallel configuration with itself when the cover is in the closed position.

In accordance with another aspect of the present invention, the space saving luggage assembly further comprises a rotatable reel retaining a wrapped portion of a length of the tube, the rotatable reel operably configured to rotate and unwrap the wrapped portion of the length of the tube, thereby providing the tube the ability to extend into the article placement zone.

In accordance with yet another feature of the present invention, the space saving luggage assembly reel further comprises a tube-storing position along a reel rotation path with greater than approximately 50% of the length of the tube wrapped around the reel; and a tube-use position along the reel rotation path with less than 25% of the length of the tube wrapped around the reel.

In accordance with a further feature of the present invention, the space saving luggage assembly further comprising a compression bag, defining an internal cavity, sized to be removably placed within the article placement zone when the cover is in the closed position. The compression bag includes a receiving surface, defining an opening fluidly coupled to the internal cavity of the compression bag, sized to receive the free end of the tube in a fluidically sealed coupling configuration.

In accordance with another feature of the present invention, the compression bag is structurally unattached to the luggage body.

In accordance with yet another feature of the present invention, the space saving luggage assembly further comprises a power source electronically coupled to the battery-powered vacuum assembly and an external outlet disposed on an exterior surface of the luggage body. The external outlet is operably configured to supply power to an external electric device, e.g., phone or laptop.

In accordance with a further feature of the present invention, the external outlet is a USB port.

In accordance with another aspect of the present invention, a space saving luggage assembly is disclosed that includes a piece of luggage with a body defining an article placement zone, a handle, and a zipper, wherein the zipper is operably configured to translate to a closed position with the body of the piece of luggage encapsulating the article placement zone and to an open position exposing the article placement zone to an ambient environment. The piece of luggage includes a battery-powered vacuum assembly integrated into an inner surface of the body of the piece of luggage and having a tube, defining a tube conduit, with a free end disposed within the article placement zone when the piece of luggage is in the closed position, the battery-powered vacuum assembly operably configured to induce a vacuum within the tube conduit.

In accordance with yet another feature of the present invention the space saving luggage assembly further comprises a bracket mechanical coupled to the inner surface of the body, the bracket defining a receiving surface adapted to removably retain a portion of the tube.

In accordance with another feature of the present invention, the tube is removably fixedly retained to the inner surface of the body when the piece of luggage is in the closed position.

In accordance with a further feature of the present invention, the tube further comprises a storing position with the tube in an overlapping and substantially parallel configuration when the piece of luggage is in the closed position.

In accordance with another aspect of the present invention, the space saving luggage further comprises a compression bag, defining an internal cavity, sized to be removably placed within the article placement zone when the piece of luggage is in the closed position. The compression bag has a receiving surface, defining an opening fluidly coupled to the internal cavity of the compression bag, sized to receive the free end of the tube in a fluidically sealed configuration.

In accordance with yet another feature of the present invention, the compression bag is structurally unattached to the luggage body.

In accordance with a further feature of the present invention, the space saving luggage assembly further comprises a power source electronically coupled to the battery-powered vacuum assembly and an external outlet disposed on an exterior surface of the body of the piece of luggage, the external outlet operably configured to supply power to an electric device.

In accordance with another aspect of the present invention, a space saving luggage assembly comprises a luggage body having a base including an inner back support surface and a plurality of rigid side walls extending in a direction away from the back surface and surrounding the inner back support surface. The plurality of rigid side walls and the inner back support surface defines an article placement zone. The luggage assembly also includes a cover coupled to the base and has an open position exposing the article placement zone to an ambient environment and a closed position encapsulating the article placement zone. The luggage assembly also includes a battery-powered vacuum assembly integrated into one of the plurality of rigid side walls, unexposed to the ambient environment when the cover is in the closed position. The vacuum assembly includes a tube, defining a tube conduit, with a free end disposed within the article placement zone when the cover is in the closed position and is operably configured to induce a vacuum within the tube conduit.

In accordance with another feature of the present invention, the space saving luggage assembly further comprises a bracket mechanical coupled to at least one of the plurality of rigid side walls, the bracket defining a receiving surface adapted to removably retain a portion of the tube.

In accordance with yet another feature of the present invention, the tube is removably fixedly retained to at least one of the plurality of rigid side walls when the cover is in the closed position.

The invention provides a space saving luggage assembly that overcomes the hereinafore-mentioned disadvantages of the heretofore-known devices and methods of this general type and that provides a user the ability to maintain the look and versatility of typical luggage.

Although the invention is illustrated and described herein as embodied in a space saving luggage assembly, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the luggage. "Luggage" is defined as bag(s) and suitcase(s) that a person carries when traveling. The terms "program," "software application," and the like as used herein, are defined as a sequence of instructions designed for execution on a computer system. A "program," "computer program," or "software application" may include a subroutine, a function, a procedure, an object method, an object implementation, an executable application, an applet, a servlet, a source code, an object code, a shared library/dynamic load library and/or other sequence of instructions designed for execution on a computer system.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
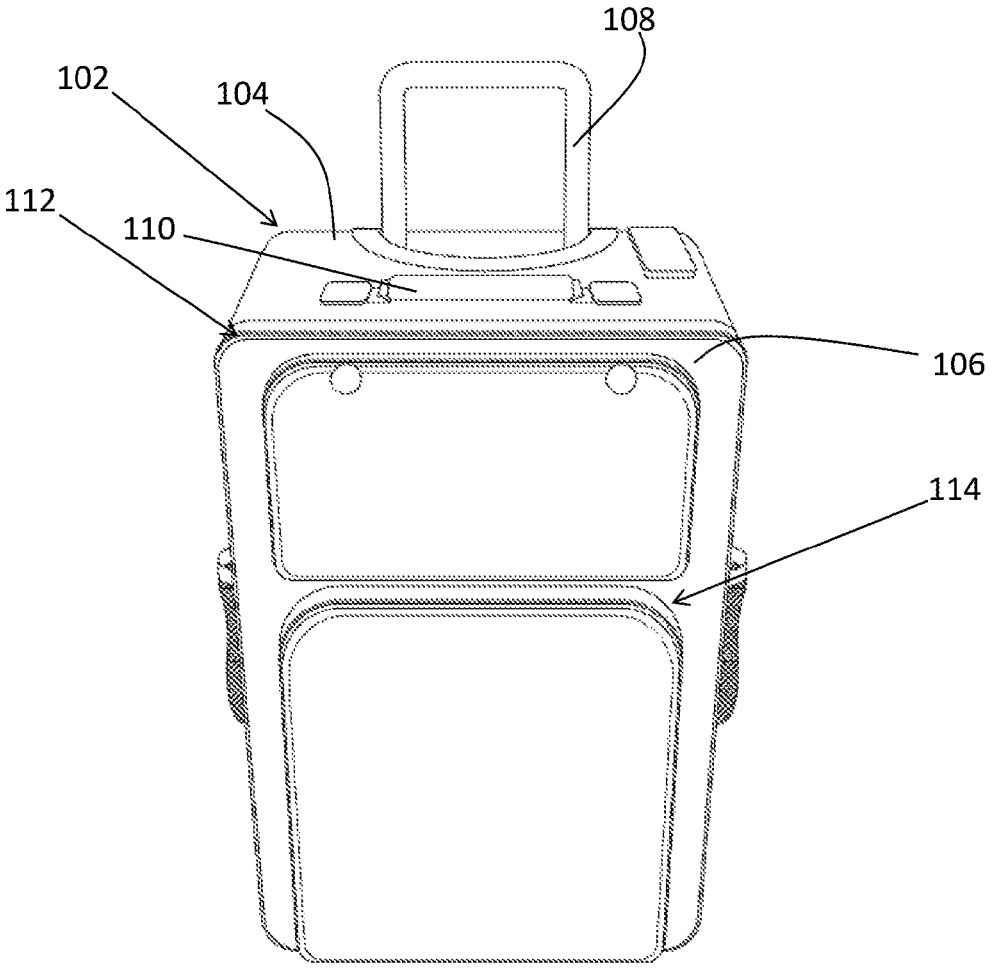
FIG. 1 is a perspective downward-looking view of a space saving luggage assembly in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient space saving luggage assembly that provides users the ability to maximize spatial efficiency within a luggage using a compression bag and an effectively placed vacuum assembly. The placement and incorporation of the vacuum assembly provides users with this effective configuration without jeopardizing the visual or structural appearance found in typical pieces of luggage. Embodiments of the invention also provide users with the ability to utilize the power source electrically coupled to the vacuum assembly to charge his or her electronic device.

Figure 2:
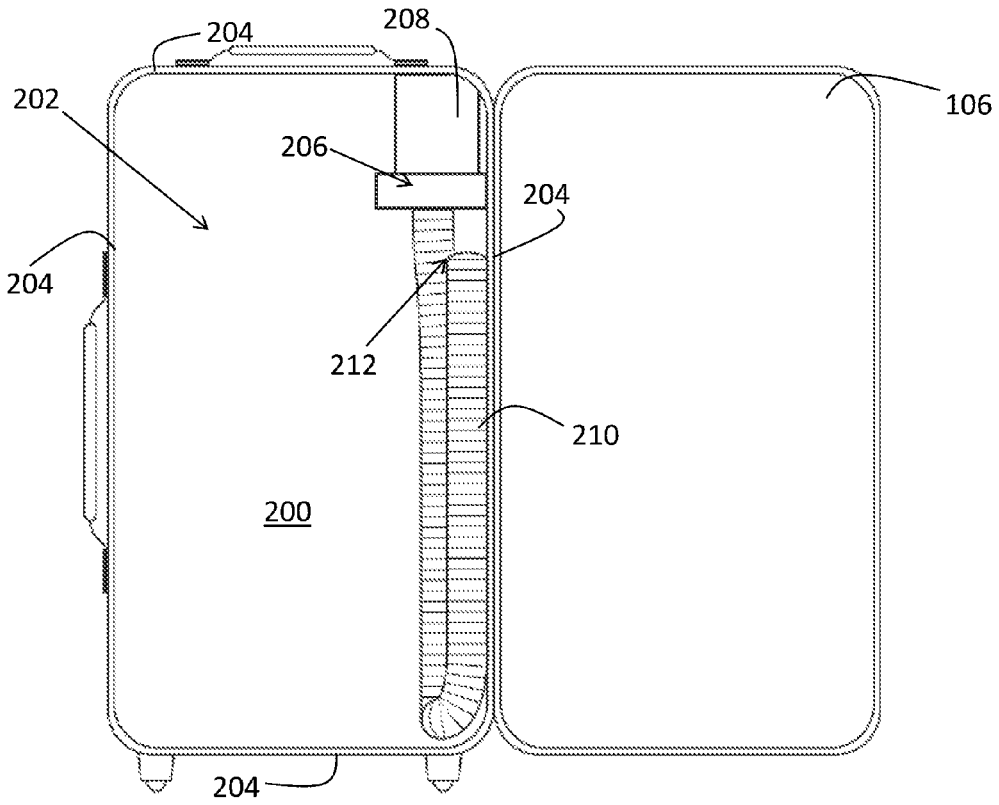
FIG. 2 is a top plan view of the front the luggage assembly of FIG. 1 when the luggage in an open position in accordance with the present invention.

Referring now to FIGS. 1 and 2, one embodiment of a space saving luggage assembly 100 is shown in a downward-looking perspective view and top plan view, respectively. FIG. 1 shows several advantageous features of the present invention, but, as will be described below, the invention can be provided in several shapes, sizes, combinations of features and components, and varying numbers and functions of the components. Unlike some luggage assemblies that incorporate a vacuum assembly that is encapsulated by a housing that protrudes from the outer surface of the luggage or that is otherwise exposed for contact and impact while the luggage is in-use, the space saving luggage assembly 100 depicted in FIG. 1 has the visual appearance of a typical suitcase. This difference is not only beneficial for luggage users because it deters potential theft of the luggage, but it is also beneficial to many users because the luggage is more easily storable while in transport and minimizes damage to the luggage caused by the increase in size of the luggage. The luggage 100 in FIG. 1 can be seen with a luggage body 102, a base 104, a cover 106, an outer surface 114, and two handles 108, 110. As will be appreciated by those of skill in the art, the location, style, shape, and quantity of handles 108, 110 and other components of the luggage body 102 may be vary.

The cover 106 may be coupled to the base 104 through piece of cloth, plastic, metal—including a zipper assembly 112, or other material. The cover 106 may be permanently attached to the base 104, via a member that acts like hinge, or may be completely removable. In other embodiments, when the luggage 100 is a duffle bag, other type of bag, or a different type of suitcase, the cover 106 will not be rotatable with respect to the base 104 as shown in FIG. 1, and the cover 106 will simply be a top of the luggage assembly 100 that may be opened and closed as discussed further herein. As shown in FIG. 1, the piece of luggage 100 is shown with the cover 106 in a closed position.

With specific reference now to FIG. 2, the piece of luggage 100 is shown with the cover 106 in an open position exposing an article placement zone 200 to an ambient environment. The ambient environment is any volume or area displaced from the outer surface 114 of the assembly 100 that does not include the article placement zone 200. The article placement zone 200 is defined by all of the internal, or inner, surfaces of the base 104. As shown in FIG. 2, the base 104 has an inner back support surface 202 and a plurality of side walls 204. The side walls 204—which, in addition to the inner back surface, are substantially free from any apertures so as to prevent any articles placed in the article placement zone 200 from exiting the luggage body 102—can be seen extending in a direction away from, and surrounding, the back surface 202. As such, the plurality of side walls 204 and the inner back support surface 202 define the article placement zone 200. While the plurality of walls 204 are substantially perpendicular to the back surface 202, in other embodiments, the orientation may vary without deviating from the spirit and scope of the present invention.

Figure 3:
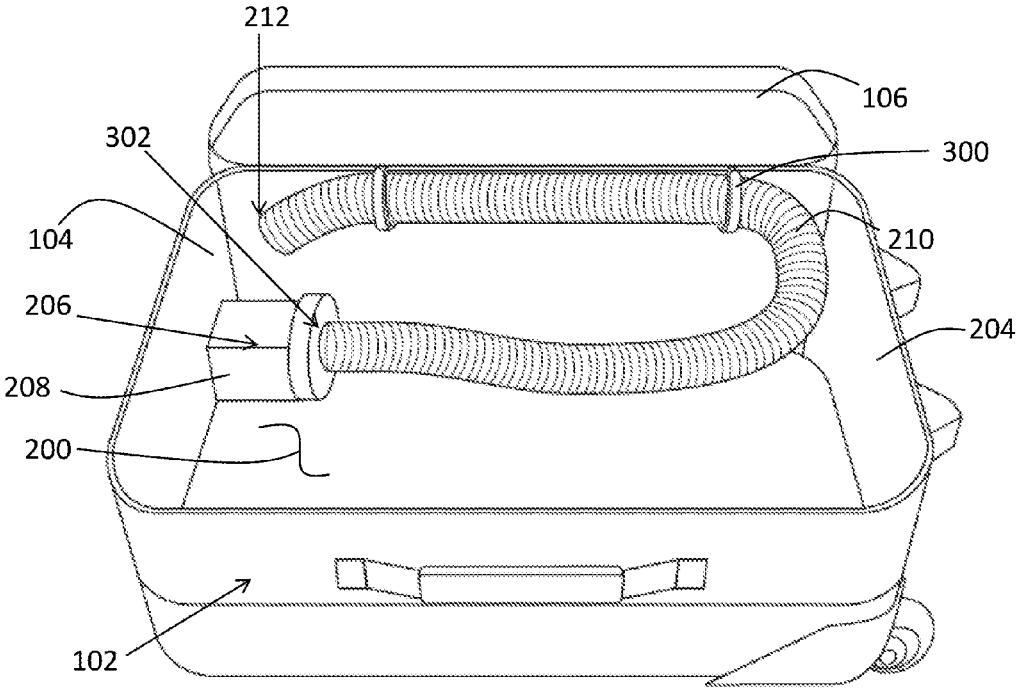
FIG. 3 is a perspective view of a vacuum assembly disposed within the internal volume of the luggage assembly in accordance with one embodiment of the present invention.

With reference now to FIGS. 2 and 3, the luggage 100 of the present invention includes a battery-powered vacuum assembly 206 integrated into one of the plurality of side walls 204. Said another way, the battery-powered vacuum assembly 206 is directly and mechanically attached to at least one of the plurality of side walls 204. In one embodiment, this may include a housing 208 of the vacuum assembly 206 bolted, screwed, or bonded with adhesive to the fabric of one of the side walls 204. In other embodiments, this may include the housing 208 of the vacuum assembly 206 bolted, screwed, or bonded with adhesive to a support member, e.g., a plastic insert, used to make the side wall 204 rigid. In further embodiments, it may be connected to both the fabric and the support member. The powered vacuum assembly 206 may also be integrated into another portion of the body 102, e.g., back support surface 202, such that at least a tube 210 coupled to the assembly 206 is disposed within article placement zone 200 is accessible to the user.

When retrofitting the vacuum assembly 206 to an existing suitcase, the housing 208 may be integrated with the plastic insert that is typically found on most suitcases by predrilling apertures in the wall of the suitcases and inserting bolts that are fastened with nuts. In other embodiments, the suitcase may be prefabricated with a support member that is of a metallic, a plastic, or a composite material with more rigid properties compared to those plastic inserts typically used with suitcases, i.e., a material with a thickness greater than 0.2 inch and of an equivalent hardness greater than approximately 40 Shore D. That more rigid support member may then have the housing or other part of the vacuum assembly directly coupled thereto so as to support the weight of the components of the vacuum assembly 206, which may range from approximately 2-5 pounds.

The battery-powered vacuum assembly 206 can also be seen including a tube 210 with a free end 212 disposed within the article placement zone 200. The housing 208 of the vacuum assembly 206 can be seen disposed within the article placement zone 200, but in other embodiments, the base 104 of the body 102 may be of a width sufficient to contain the housing 208 and/or the vacuum inducing components of the vacuum assembly 206. Advantageously, however, the free end 212 of the tube 210 is disposed within the article placement zone 200 when the cover is in the closed position, e.g., when the cover 106 is coupled to the base 104 such that the article placement zone 200 is encapsulated—or surrounded on all sides by material of the luggage body 102. The end 212 of the tube 210 is considered "free" because it is structurally unattached and operable to move in at least three dimensional axes. This beneficially allows users to remove the end 212 of the tube 210 so as remove the air or other gas(es) from a removable compression bag 500 (shown in FIG. F).

The vacuum assembly 206 may include a motor that is operably configured to induce a vacuum, whether partial or full, within a tube conduit defined by the tube 210 so as to remove air or other gas(es)/fluid(s) from the removable compression bag 400 as described above. In one embodiment, the motor, pump, or other device used to create the suction, i.e., a pressure gradient, at the free end 212 of the tube 210 requires an amperage range from approximately 3.5 to 5.5 amps, or approximately 40-80 Watts. Other amperage requirements may also be utilized outside these ranges. As the luggage 100 is transportable and there may be some instances where the user will not have access to an electrical outlet, the vacuum assembly 206 is battery-powered. In one embodiment, the battery is a lithium-ion celled assembly generating approximately 12-15 volts. In other embodiments, the voltage and/or amperage generated by the battery may vary based on the device used to create the suction.

Figure 4:
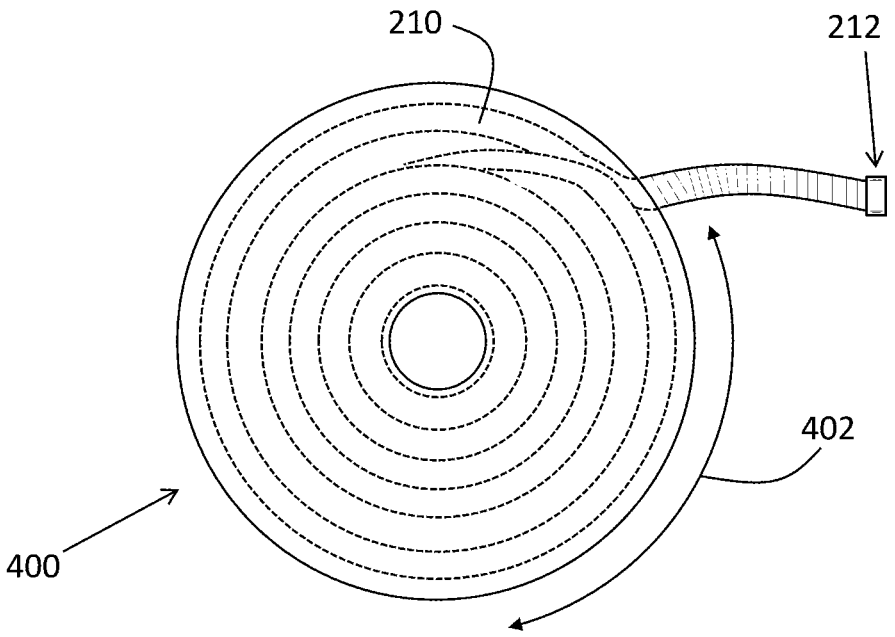
FIG. 4 is a partially cross-sectional side view of a reel assembly used to retain a tube of the vacuum assembly in accordance with one embodiment of the present invention.

Referring specifically to FIG. 3, the tube 210 can be seen advantageously stored so it can be quickly removed and attached to a compression bag 40 (as shown in FIG. 4). In one embodiment, the luggage body 102 includes one or more bracket(s) 300 mechanical coupled thereto, the bracket 300 being adapted to removably retain a portion of the tube 210. Preferably, the bracket 300 is fastened to at least one of the plurality of side walls 204 with adhesive, bolts, or other fasteners and defines a receiving surface for the tube 210 as shown in FIG. 3. The receiving surface of the bracket 300 may be contoured in the shape of a tube 210, e.g., having a U-shape, and sized to be the same or slightly larger than the diameter, i.e, width, of the tube 210 to provide a tight fit. The bracket 300 permits the tube 210 to be removably fixedly retained to at least one of the plurality of side walls 204 when the cover 106 is in the closed position. Said another way, when the luggage assembly 100 is in use or being transported, the tube 210 coupled to the side wall(s) 204, not readily movable so it does not shift or move around within the article placement zone 200—unless desired by the user, and held in place or position by an object, e.g., a bracket or adhesive, that does not directly include the fabric or side wall support member. This not only permits maximum spatial efficiency within the article placement zone 200—so as to allow the user to insert more clothing or other items, but it also reduces the possibility of damaging the tube 210. In other embodiments, the tube 210 is removably fixedly retained to the side wall 204 with a clamp, magnets, or other fastener/bracket.

The tube 210 may also include a storing position with the tube in an overlapping and substantially parallel configuration with itself (as shown in FIG. 3) when the cover 106 is in the closed position. This configuration beneficially permits the tube 210 to be accessible for use by the user, yet minimizes the space occupied in the article placement zone 200. In one embodiment, the storing position includes the tube 210 in an overlapping and substantially parallel configuration with itself while retained to one of the plurality of side walls 204. In other embodiments the tube 210 may have a storing position not while coupled to a side wall 204. An operational position of the tube 210 will include it not being in an overlapping configuration. In one embodiment, the length of the tube 210—extending from a proximal end 302 to the free end 212—is approximately 2-3 feet, but in other embodiments may be outside of said range. The diameter or width of the tube 210 may be approximately 1-3 inches in one embodiment, but may be outside of that range depending on the design constraints.

With reference now to FIG. 4, the vacuum assembly 206 includes a rotatable reel 400 retaining a wrapped portion of the length of the tube 210. Beneficially, the rotatable reel 400 is operably configured to rotate and unwrap the wrapped portion of the length of the tube 210, thereby providing the tube 210 the ability to extend into the article placement zone 200. The reel 400 also allows more of the article placement zone 200 to be used for clothing and other articles of the user. When in a storing position, the tube 210 may be wound around the reel and locked into position using spring-based tensioning assembly. To unwrap the tube 210, the user pulls on the free end 212 of the tube 210 and the reel 400 will rotate as in the direction shown by the arrow 402. The reel 400 may be retracted by pulling slightly on the tube 210 to un-engage a tensioner, whereby the spring—which is biasing the tube 210—applies a force that winds the tube 210 back around the reel. In other embodiments, the reel 400 may be operable for the user to mechanically wind the tube 210 around the reel 400.

Figure 5:
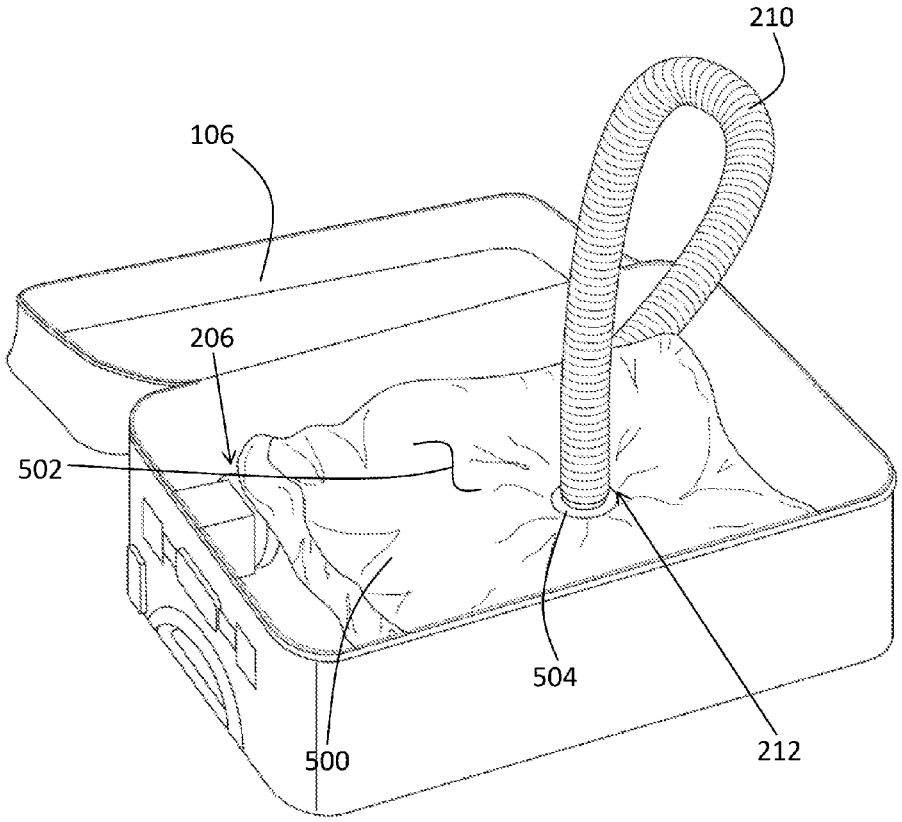
FIG. 5 is a perspective view of the vacuum assembly of the luggage assembly in FIGS. 2 and 3 coupled to a removable compression bag so as to remove air within in accordance the present invention.

When utilizing the reel 400, the reel 400 may be said to have a tube-storing position along a reel rotation path—evidenced with the arrow 402—with greater than approximately 50% of the length of the tube 210 wrapped around the reel 400. This position is illustrated in FIG. 4. The reel 400 may also have a tube-use position along the reel rotation path with less than 25% of the length of the tube 210 wrapped around the reel 400. FIG. 5 illustrates an example of the tube-use position with greater than 75% of the length of the tube 210 unwrapped around the reel 400, i.e., less than 25% of the length of the tube 210 wrapped around the reel 400. Again, the beneficial position(s) of the tube 210 around the reel 400 provide a spatially efficient and effective configuration so as maximize the amount of articles to be packed within the luggage 100.

With reference to FIG. 5, the luggage assembly 100 is shown from a downward-looking perspective view. Unlike many other space saving luggage assemblies, the present invention utilizes a compression bag 500—also referred to as a vacuum bag—that is advantageously removable. As will be readily appreciable by those of skill in the art, the compression bag 500 defines an internal cavity 502 and includes a receiving surface 504 that is sized to receive the free end 212 of the tube 210 in a fluidically sealed coupling configuration. The receiving surface 504 defines an opening that is fluidly coupled to the internal cavity 502 of the compression bag 500. In one example, a vacuum bag 500 may be approximately 35"×28" in size with a receiving surface 504 of approximately 1 inch in diameter, while the free end 212 of the tube 210 is approximately 1.01 inches in diameter, and may include one or more rubber gaskets to have or approach a hermetic seal. Standard with many vacuum bags, a valve may be utilized to prevent ambient air from entering the bag after sealed. In other embodiments, a cap for the receiving surface 504 may be utilized. Because the vacuum assembly 206 is incorporated into the luggage body 102 with the tube 210 disposed within the article placement zone 200 for removable attachment, a vacuum bag 500 that is removable is able to be used. In that regard, the present invention provides versatility as users may use various and different sized commercially produced vacuum bags. This is beneficial as many users desire to have different types of clothes compartmentalized in different bags, e.g., dirty clothes from clean clothes or shirts from undergarments.

To achieve maximum versatility, the vacuum bag(s) 500 are structurally unattached to the luggage body 102 so as effectively and efficiently remove the bags with minimal effort from the user. The limitation with regard to the compression bag(s) 500 is that they are sized to be removably placed within the article placement zone 200 when the cover 106 is in the closed position. The sizes of the compression bag(s) 500 may vary, but it should be less in volume—whether in its compressed or uncompressed state—so that it can fit within the article placement zone 200.

Figure 6:
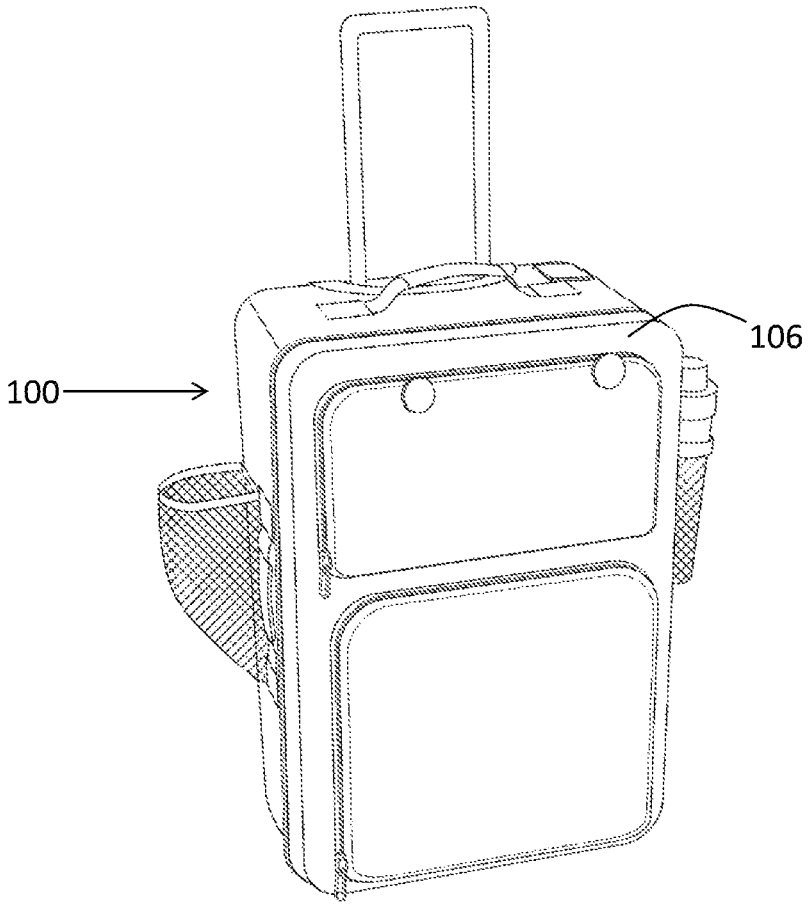
FIG. 6 is another perspective downward-looking view of the luggage assembly of FIG. 1 with a container in the container holders in accordance with one embodiment of the present invention.

FIG. 6 illustrates a view of the luggage assembly 100 while the cover 106 is in the closed position. Because of the advantageous placement of the vacuum assembly 206 discussed above, the suitcase's physical appearance emulates those typical suitcases, thereby reducing the chance of theft and damage to any components of the vacuum assembly 206—which was a prevalent problem with known luggage using vacuum assemblies.

Figure 7:
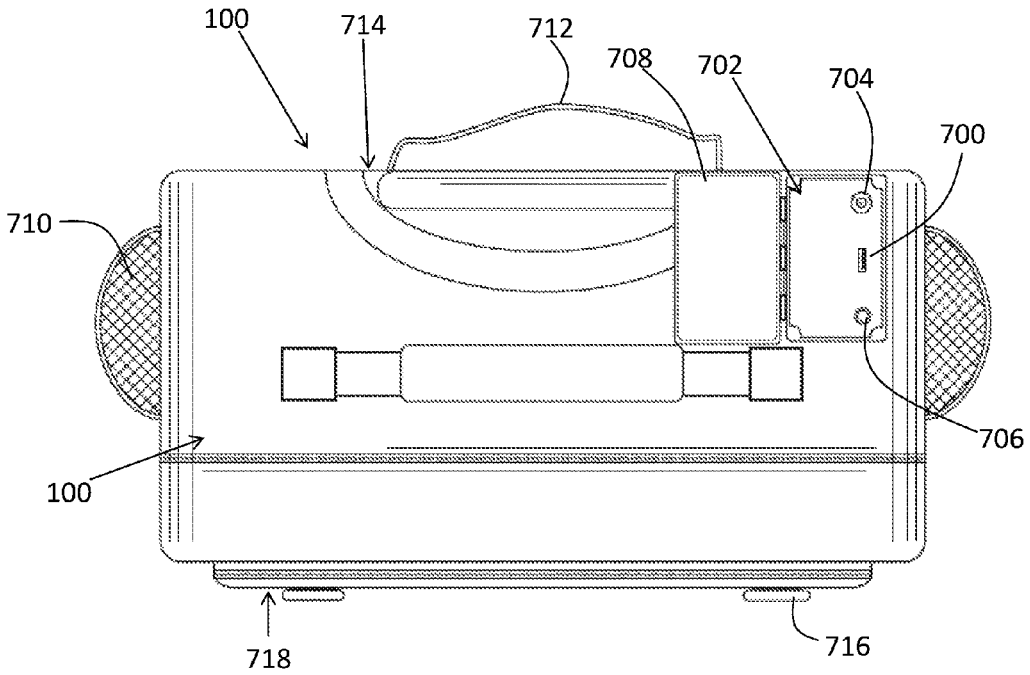
FIG. 7 is a top plan view of the top of the luggage assembly of FIG. 1.
Figure 8:
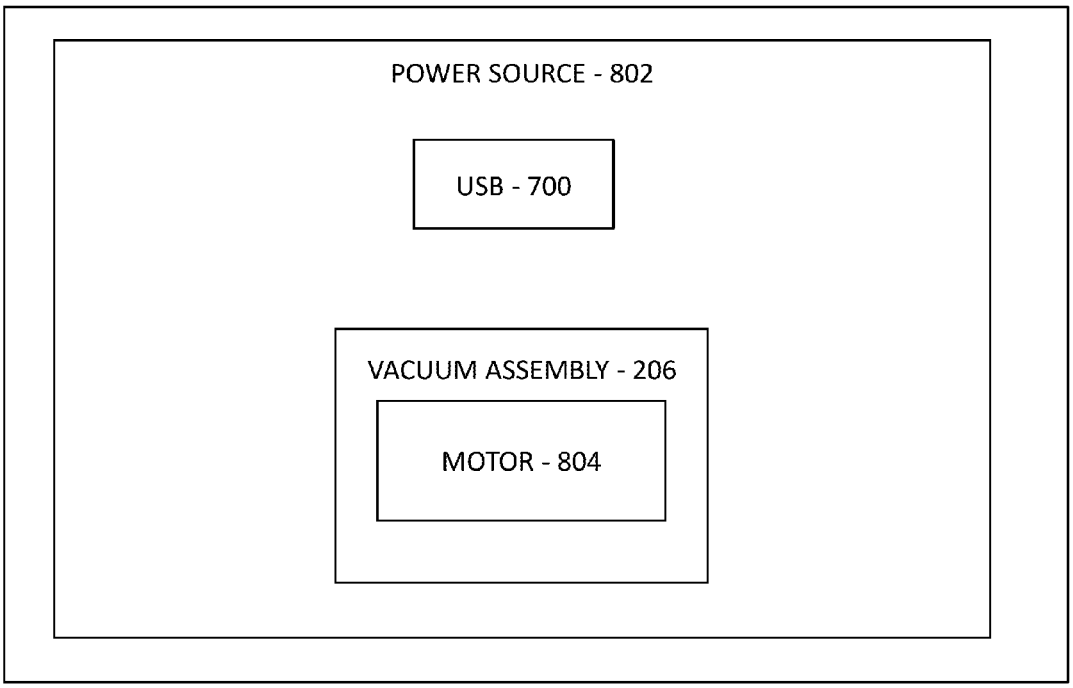
FIG. 8 is a block diagram depicting exemplary components used in the vacuum assembly in accordance with one embodiment of the present invention.

With reference now to FIGS. 7 and 8, the luggage assembly 100 also includes a power source 802 electronically coupled to the battery-powered vacuum assembly 206 and an external outlet 700 disposed on an exterior surface 114 of the luggage body 102. Beneficially, the external outlet 700 is operably configured to supply power 802 to an external (i.e., not part of the luggage assembly 100) electric device, e.g., a cellular phone. This is extremely beneficial for those users that travel and are in the need to charge their phone(s) or other electronic devices without access to any available wall outlets. As the power supply 802 delivers power to both the electrical device and the vacuum assembly 206 the electrical system can maximize spatial efficiency. In one embodiment, the external outlet is of a USB port 700 is operable to deliver approximately 5-12 volts with approximately 100-1000 mA. In other embodiments, based on the battery capacity and design constraints, the aforementioned voltage and amperage ratings may vary. Other external outlets may include FireWire, Ethernet, and others. To accommodate for the different varying voltage and/or amperage outputs, the power source 802 may be coupled to one or more transformers and the electric system may utilize other electrical components appreciable to those of skill in the art.

FIG. 7 also depicts a panel 702 that includes the external outlet 700 and also the input 704 to connect a charger for the power source 802 and one or more indicators 706 that display the level of power available in the power source 802. In one embodiment, the level of power is displayed through an electronic display and in other embodiments a red light indicates a low level of power, a yellow light indicates a minimal level of power (e.g., less than 20%), and a green light indicates a high level of power (e.g., greater than 20%). The panel 702 may also include a cover 708 to prevent damage to the external outlet(s) 700 while transporting of the luggage assembly 100 and to maintain the look of an ordinary piece of luggage, as described above.

Figure 9:
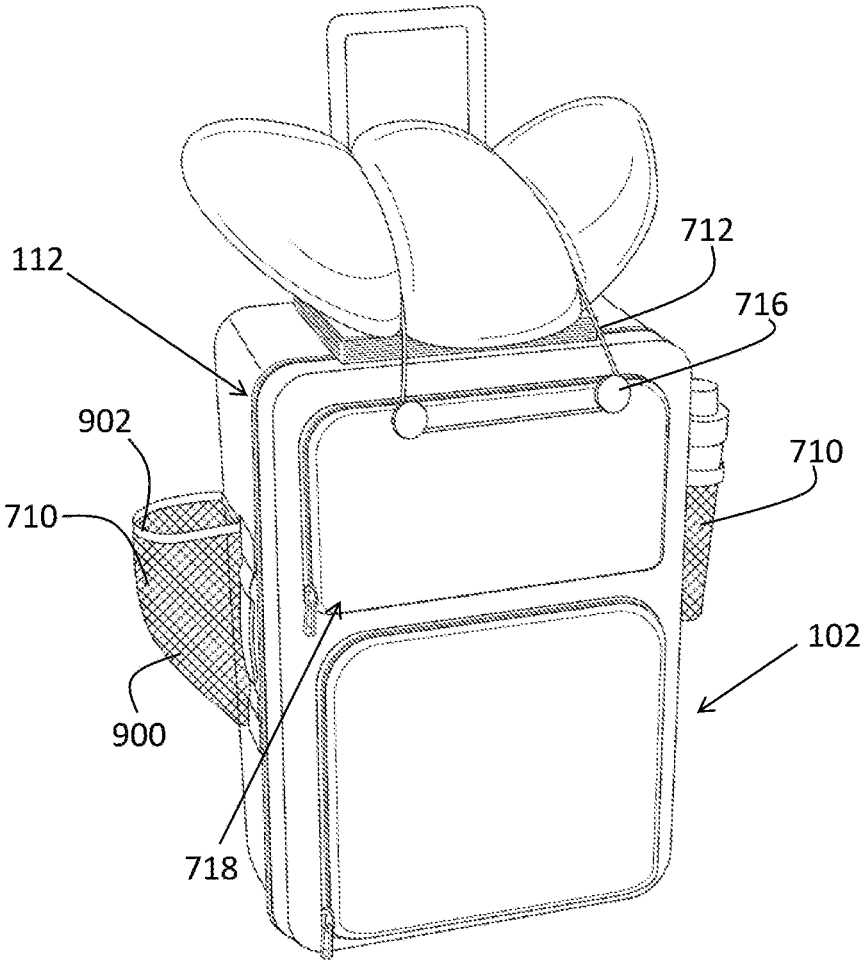
FIG. 9 is a perspective downward-looking view of the luggage assembly of FIG. 1 with an elastic cord coupled to fastening members to retain a pillow in accordance with one embodiment of the present invention.

With reference now to FIGS. 7 and 9, another advantageous feature of the luggage assembly 100 can be seen. Specifically, one or more container holder(s) 710 are placed on the sides of the luggage body 102 and may be of a fabric mesh material 900 with an elastic upper lining 902 to accommodate varying sized beverages. Also, the luggage assembly 100 can be seen having an elastic cord 712 on the back 714 of the luggage 100 and one or more hook(s) or other retaining member(s) 716 on the front 718 of the luggage. In other embodiments, the position of the elastic cord 712 and retaining member(s) 716 may vary. FIG. 9 also depicts the closed position of the body 102 of the piece of luggage 100 via the zipper 112 that is operably configured to translate around the piece of luggage 100, as appreciated by both those of skill in the art.

A novel and efficient space saving luggage assembly has been disclosed enables users to use removable compression bags with a conveniently and effectively placed vacuum assembly. This placement results in the spatial efficiency within a luggage to be maximized so that the internal cavity or volume within the luggage can be utilized with compression bags, clothing, and other items, without jeopardizing the visual or structural appearance desired for typical pieces of luggage.

What is claimed is:

1. A space saving luggage assembly comprising:

a luggage body having:

a base including a handle coupled thereto, an inner back support surface, and a plurality of side walls extending in a direction away from the back surface and surrounding the inner back support surface, the plurality of side walls and the inner back support surface defining an article placement zone; and a cover coupled to the base, the cover having an open position exposing the article placement zone to an ambient environment and a closed position encapsulating the article placement zone;

a battery-powered vacuum assembly integrated into one of the plurality of side walls and having a tube, defining a tube conduit, with a free end disposed within the article placement zone when the cover is in the closed position, the battery-powered vacuum assembly operably configured to induce a vacuum within the tube conduit; and a bracket mechanically coupled to at least one of the plurality of side walls, the bracket defining a receiving surface adapted to removably retain a portion of the tube.

2. The space saving luggage assembly according to claim 1, wherein:

the tube is removably fixedly retained to at least one of the plurality of side walls when the cover is in the closed position.

3. The space saving luggage assembly according to claim 2, wherein the tube further comprises:

a storing position with the tube in an overlapping and substantially parallel configuration with itself when the cover is in the closed position.

4. The space saving luggage assembly according to claim 1, further comprising:

a compression bag, defining an internal cavity, sized to be removably placed within the article placement zone when the cover is in the closed position, the compression bag including a receiving surface, defining an opening fluidly coupled to the internal cavity of the compression bag, sized to receive the free end of the tube in a fluidically sealed coupling configuration.

5. The space saving luggage assembly according to claim 4, wherein:

the compression bag is structurally unattached to the luggage body.

6. The space saving luggage assembly according to claim 1, further comprising:

a power source electronically coupled to the battery-powered vacuum assembly and an external outlet disposed on an exterior surface of the luggage body, the external outlet operably configured to supply power to an external electric device.

7. The space saving luggage assembly according to claim 6, wherein:

the external outlet is of a USB port.

8. A space saving luggage assembly comprising:

a piece of luggage with a body defining an article placement zone, a handle, and a zipper, the zipper operably configured to translate to a closed position with the body of the piece of luggage encapsulating the article placement zone and to an open position exposing the article placement zone to an ambient environment;

a battery-powered vacuum assembly integrated into an inner surface of the body of the piece of luggage and having a tube, defining a tube conduit, with a free end disposed within the article placement zone when the piece of luggage is in the closed position, the battery-powered vacuum assembly operably configured to induce a vacuum within the tube conduit; and a bracket mechanically coupled to the inner surface of the body, the bracket defining a receiving surface adapted to removably retain a portion of the tube.

9. The space saving luggage assembly according to claim 8, wherein:

the tube is removably fixedly retained to the inner surface of the body when the piece of luggage is in the closed position.

10. The space saving luggage assembly according to claim 9, wherein the tube further comprises:

a storing position with the tube in an overlapping and substantially parallel configuration when the piece of luggage is in the closed position.

11. The space saving luggage assembly according to claim 8, further comprising:

a compression bag, defining an internal cavity, sized to be removably placed within the article placement zone when the piece of luggage is in the closed position, the compression bag defining a receiving surface, defining an opening fluidly coupled to the internal cavity of the compression bag, sized to receive the free end of the tube in a fluidically sealed configuration.

12. The space saving luggage assembly according to claim 11, wherein:

the compression bag is structurally unattached to the luggage body.

13. The space saving luggage assembly according to claim 8, further comprising:

a power source electronically coupled to the battery-powered vacuum assembly and an external outlet disposed on an exterior surface of the body of the piece of luggage, the external outlet operably configured to supply power to an electric device.

14. A space saving luggage assembly comprising:

a luggage body having:

a base including an inner back support surface and a plurality of rigid side walls extending in a direction away from the back surface and surrounding the inner back support surface, the plurality of rigid side walls and the inner back support surface defining an article placement zone; and a cover coupled to the base, the cover having an open position exposing the article placement zone to an ambient environment and a closed position encapsulating the article placement zone;

a battery-powered vacuum assembly integrated into one of the plurality of rigid side walls, unexposed to the ambient environment when the cover is in the closed position, and having a tube, defining a tube conduit, with a free end disposed within the article placement zone when the cover is in the closed position, the battery-powered vacuum assembly operably configured to induce a vacuum within the tube conduit; and a bracket mechanically coupled to at least one of the plurality of rigid side walls, the bracket defining a receiving surface adapted to removably retain a portion of the tube.

15. The space saving luggage assembly according to claim 14, wherein:

the tube is removably fixedly retained to at least one of the plurality of rigid side walls when the cover is in the closed position.

* * * * *